US009574427B2

(12) United States Patent
Dirksen

(10) Patent No.: US 9,574,427 B2
(45) Date of Patent: Feb. 21, 2017

(54) ASSEMBLY AND METHOD FOR SUBSEA HYDROCARBON GAS RECOVERY

(71) Applicant: Halliburton Energy Services, Inc., Houston, TX (US)

(72) Inventor: Ronald Johannes Dirksen, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/440,319

(22) PCT Filed: Dec. 13, 2012

(86) PCT No.: PCT/US2012/069439
§ 371 (c)(1),
(2) Date: May 1, 2015

(87) PCT Pub. No.: WO2014/092709
PCT Pub. Date: Jun. 19, 2014

(65) Prior Publication Data

US 2015/0300130 A1 Oct. 22, 2015

(51) Int. Cl.
*E21B 7/12* (2006.01)
*E21B 43/01* (2006.01)
(Continued)

(52) U.S. Cl.
CPC ..... *E21B 43/01* (2013.01); *E21B 7/12* (2013.01); *E21B 7/128* (2013.01); *E21B 7/26* (2013.01);
(Continued)

(58) Field of Classification Search
None
See application file for complete search history.

(56) References Cited

U.S. PATENT DOCUMENTS 3,602,320 A 8/1971 Howard
4,054,104 A 10/1977 Haselton
(Continued)

FOREIGN PATENT DOCUMENTS

EP 2458137 A1 5/2012
WO WO0047832 A1 8/2000
(Continued)

OTHER PUBLICATIONS

International Search Report and the Written Opinion of the International Searching Authority, or the Declaration, Feb. 20, 2013, PCT/US2012/069439, 12 pages, ISA/US.

*Primary Examiner* — Matthew R Buck
*Assistant Examiner* — Douglas S Wood
(74) *Attorney, Agent, or Firm* — Haynes and Boone, LLP

(57) ABSTRACT

An assembly to recover hydrocarbon gas from a seabed comprises one or more self-propelled drilling devices that include hydrocarbon sensors and a sublimation mechanism to induce sublimation of crystallized hydrates into hydrocarbon gases. As the drilling device moves through the wellbore, hydrocarbon deposits are detected and the sublimation mechanism induces sublimation of the deposits to release hydrocarbon gases up through the formation to the seabed. A bladder is positioned atop the wellbore to capture the release hydrocarbon gas and transfer it to a surface vessel for collection.

20 Claims, 3 Drawing Sheets

(51) Int. Cl.

| | |
|---|---|
| ***E21B 28/00*** | (2006.01) |
| ***E21B 36/00*** | (2006.01) |
| ***E21B 47/00*** | (2012.01) |
| ***E21B 7/26*** | (2006.01) |
| ***E21B 7/128*** | (2006.01) |
| ***E21B 17/01*** | (2006.01) |
| ***E21B 19/00*** | (2006.01) |
| ***E21B 43/00*** | (2006.01) |
| ***E21B 43/24*** | (2006.01) |

(52) U.S. Cl.

CPC ..... *E21B 17/01* (2013.01); *E21B 19/002* (2013.01); *E21B 28/00* (2013.01); *E21B 36/00* (2013.01); *E21B 43/003* (2013.01); *E21B 43/0122* (2013.01); *E21B 43/2401* (2013.01); *E21B 47/00* (2013.01)

(56) References Cited

U.S. PATENT DOCUMENTS

| | | | | |
|---|---|---|---|---|
| 5,950,732 | A | 9/1999 | Agee et al. | |
| 6,209,965 | B1 | 4/2001 | Borns et al. | |
| 6,299,256 | B1 | 10/2001 | Wyatt | |
| 6,725,924 | B2 | 4/2004 | Davidson et al. | |
| 7,055,625 | B1 * | 6/2006 | Myrick | E21B 49/06 175/26 |
| 7,546,880 | B2 * | 6/2009 | Zhang | E21B 43/0122 166/302 |
| 7,597,148 | B2 | 10/2009 | O'Malley et al. | |
| 8,353,348 | B2 * | 1/2013 | Chitwood | E21B 4/04 166/302 |
| 8,651,177 | B2 * | 2/2014 | Vail, III | E21B 28/00 166/119 |
| 2003/0136585 | A1 | 7/2003 | Matsuo et al. | |
| 2007/0265782 | A1 | 11/2007 | Kleinberg et al. | |
| 2010/0006281 | A1 | 1/2010 | DuBrucq | |
| 2010/0132933 | A1 | 6/2010 | Nakamura et al. | |
| 2012/0226443 | A1 | 9/2012 | Cresswell et al. | |
| 2012/0273216 | A1 | 11/2012 | Beynet et al. | |

FOREIGN PATENT DOCUMENTS

| | | | |
|---|---|---|---|
| WO | WO2008073495 | A1 | 6/2008 |
| WO | WO2010000289 | A1 | 1/2010 |
| WO | WO2012021813 | A1 | 2/2012 |

* cited by examiner

ASSEMBLY AND METHOD FOR SUBSEA HYDROCARBON GAS RECOVERY

The present application is a U.S. National Stage patent application of International Patent Application No. PCT/US2012/069439, filed on Dec. 13, 2012, the benefit of which is claimed and the disclosure of which is incorporated herein by reference in its entirety.

FIELD OF THE INVENTION

The present invention relates generally to subsea hydrocarbon exploration and, more specifically, to an assembly and method for recovering hydrocarbon gas from the seabed.

BACKGROUND

During conventional subsea drilling operations, hydrocarbon gases are sometimes released from the formation and into the atmosphere. One such example is methane gas, which exists in subsea formations as methane hydrate, a crystallized methane deposit primarily located in vast amounts at shallow depths beneath the ocean floor. In addition, this crystallized methane may cap even larger deposits of gaseous methane.

Recovery of methane hydrates is difficult because it will not flow in the subsurface environment, as it only exists in a solid form. In addition, the methane hydrates may disappear through a phenomenon referred to as "sublimation." Sublimation is the process by which a compound, through alteration of its temperature or pressure, transforms directly from a solid to gas phase, without passing through an intermediate liquid phase. As such, when the delicate pressure or temperature balance of the downhole environment is disturbed, the methane hydrates sublimate, thus escaping up through the formations and seawater, then out into the atmosphere where they only contribute to the controversial greenhouse gas problem. Thus, the traditional way of recovering hydrocarbon deposits through drilling wellbores into the hydrocarbon bearing formations, and letting the hydrocarbons flow into the wellbore and up to surface, is not feasible.

In view of the foregoing, there is a need in the art for cost-effective method by which to recover hydrocarbon gases from the seabed, thereby preventing the release of harmful gases into the atmosphere while also harnessing valuable hydrocarbon for further use.

DESCRIPTION OF ILLUSTRATIVE EMBODIMENTS

Illustrative embodiments and related methodologies of the present invention are described below as they might be employed in an assembly and method to recover hydrocarbon gas from a seabed. In the interest of clarity, not all features of an actual implementation or methodology are described in this specification. Also, the "exemplary" embodiments described herein refer to examples of the present invention. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

Figure 1:
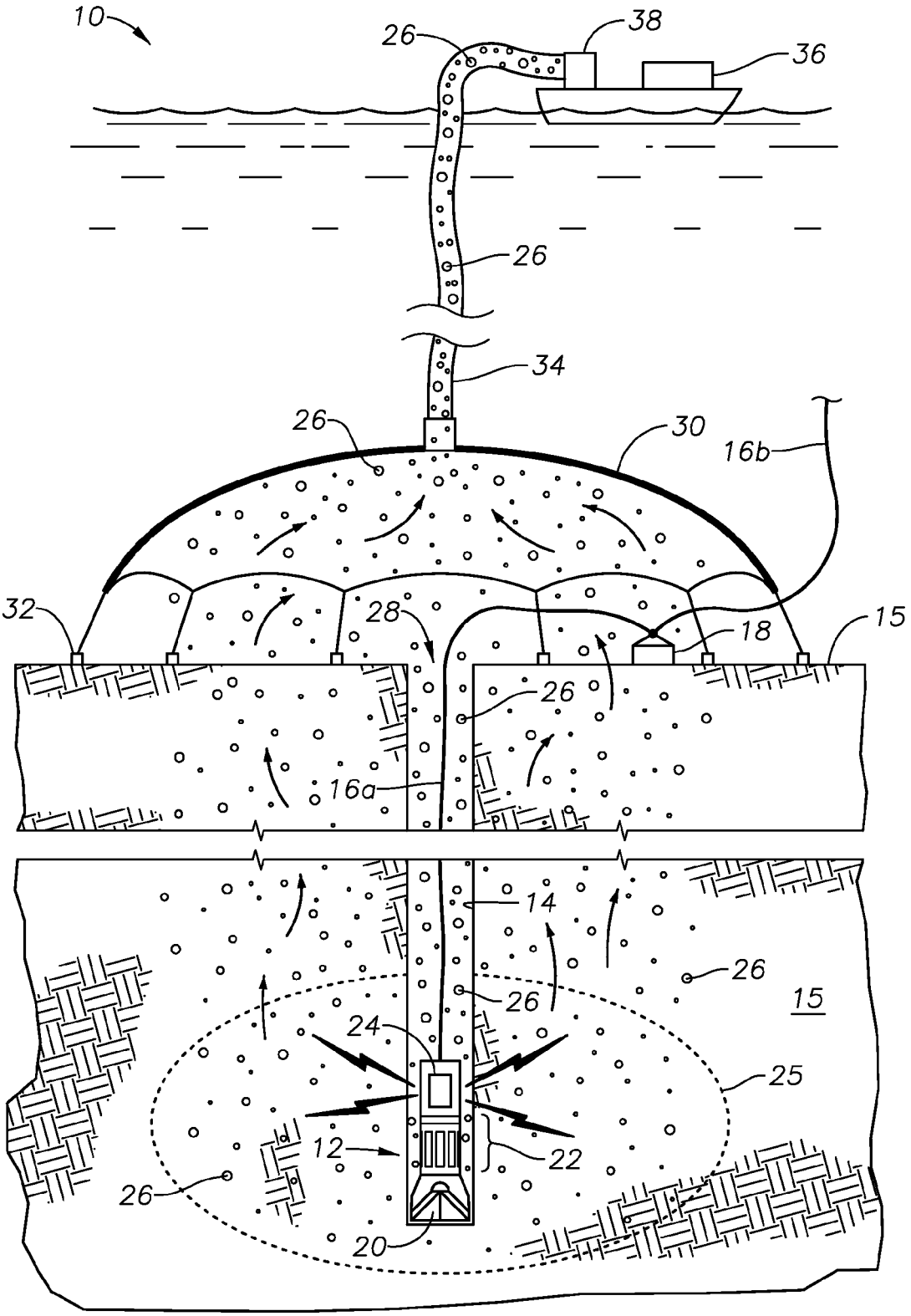
FIG. 1 illustrates an assembly to recover hydrocarbon gas from a seabed according to certain exemplary embodiments of the present invention.

FIG. 1 illustrates an assembly 10 utilized to recover hydrocarbon gases from a seabed according to certain exemplary embodiments of the present invention. Assembly 10 includes a drilling device 12 positioned at the bottom of a wellbore 14 extending along a hydrocarbon bearing formation 15. Drilling device 12 is an autonomous, self-propelled drilling device such as, for example, a Badger® Explorer self-propelled drilling system. However, those ordinarily skilled in the art having the benefit of this disclosure will realize a variety of other such self-propelled drilling devices may be utilized with the present invention.

Drilling device 12 comprises a bit 20 and associated motor (not shown) for powering the bit 20 during drilling. Although not shown, in certain exemplary embodiments, drilling device 12 may also include a second bit at the end of drilling device opposite bit 20. In such embodiments, the second bit will be utilized to drill drilling device 12 out of wellbore 14, thus adapting drilling device 12 to drill in a forward or backward direction along wellbore 14. One or more sensors 22 and associated logging circuitry are positioned along drilling device 12 in order to sense the presence of hydrocarbon deposits (methane hydrate, for example) within hydrocarbon bearing formation 15. A variety of sensors and sensing methodologies may be utilized in conjunction with sensors 22, as would be understood by one ordinarily skilled in the art having the benefit of this disclosure. The sensors could take the form of an acoustic (sonic or ultrasonic), di-electric, resistivity, nuclear or some other suitable sensor. In those embodiments utilizing acoustic devices, the injected acoustic pulse may be injected at a frequency of 2-40 KHZ, for example, as will be understood by those same ordinarily skilled persons.

In addition, drilling device 12 includes a sublimation mechanism 24 to cause sublimation of the hydrocarbon deposits located in hydrocarbon bearing formation 15. As will be understood by those ordinarily skilled in the art having the benefit of this disclosure, sublimation will result in the release of hydrocarbon gas 26 from hydrocarbon bearing formation 15 and up out of the seabed (or seafloor). Exemplary hydrocarbon deposits include, for example, methane hydrates ($CH_4$). As will be described below, drilling device 12, through the use of sublimation mechanism 24, will cause those crystallized hydrate deposits present within sublimation range 25 of hydrocarbon bearing formation 15 to sublimate directly from the crystallized, or ice, phase directly to a gas 26, whereby the gas 26 will be released through hydrocarbon bearing formation 15 and out of the seabed.

In certain embodiments, exemplary sublimation mechanisms may include, for example, one or more vibration inducing mechanisms, acoustic pulse/shockwave inducing mechanisms, or temperature inducing mechanisms. The acoustic pulse/shockwave inducing mechanism may induce pulses at 50-400 HZ in some embodiments. The vibration inducing mechanism may take a variety of forms, including, for example, a self-tuning, off-center mass vibrator positioned within drilling device 12. Other embodiments could include, for example, piezo-electric devices, electrically, or hydraulically activated hammers, etc. The temperature inducing mechanism may be, for example, an electromagnetic device utilizing technology such as used in microwave transmission systems. Moreover, the size of sublimation range 25 (the region in which sublimation mechanism 24 induces sublimation) is contingent on the power of sublimation mechanism 24, as will be understood by those ordinarily skilled in the art having the benefit of this disclosure. Nevertheless, once the shockwave, vibration or temperature alteration is injected or introduced into the hydrocarbon deposits, the hydrates within sublimation range 25 will sublimate directly into hydrocarbon gas 26 and be released through hydrocarbon bearing formation 15 to the seabed.

A cable 16*a* is coupled to drilling device 12 and extends up to a pod 18. A second cable 16*b* extends from pod 18 up to surface vessel 36 whereby drilling device 12 may be remotely controlled in certain embodiments. Surface vessel 36 may be a suitable collection vessel such as, for example, a barge, ship or floating production vessel, as will be understood by those ordinarily skilled in the art having the benefit of this disclosure. Pod 18 comprises processing capability and associated circuitry necessary for data analysis, storage and bi-directional communication between drilling device 12 and surface vessel 36. In certain embodiments, cable 16*a* transmits the electrical power and data necessary to operate drilling device 12, while 16*b* provides bi-directional communication with surface vessel 36. However, in other exemplary embodiments, drilling device 12 may include one or more of an on-board power system, processor, communication circuit or associated circuitry necessary to operate itself independently of pod 18. These and other configurations of drilling device 12 will be readily apparent to those ordinarily skilled in the art having the benefit of this disclosure.

Still referring to the exemplary embodiment of FIG. 1, wellbore 14 extends down into hydrocarbon bearing formation 15 from a seabed origination point 28. A bladder 30 is positioned over seabed origination point 28 and the portion of the seabed over the sublimation range 25 in order to capture hydrocarbon gas 26 as it is released up through hydrocarbon bearing formation 15 to the seabed. Bladder 30 extends beyond the outer diameter of seabed origination point 28 and sublimation range 25 a certain distance in order to reduce the possibility of hydrocarbon gas 28 escaping around bladder 30. In certain embodiments, bladder 30 extends beyond seabed origination point 100 feet or more. Nevertheless, bladder 30 is secured to the seabed by a spike 32 or some other stabilizer. In certain exemplary embodiments, bladder 30 may comprise edges that are weighted sufficiently to secure bladder 30 to the seabed. There are a variety of ways of which to secure the bladder above seabed origination point 28, as will be understood by those ordinarily skilled in the art having the benefit of this disclosure.

Figure 2A:
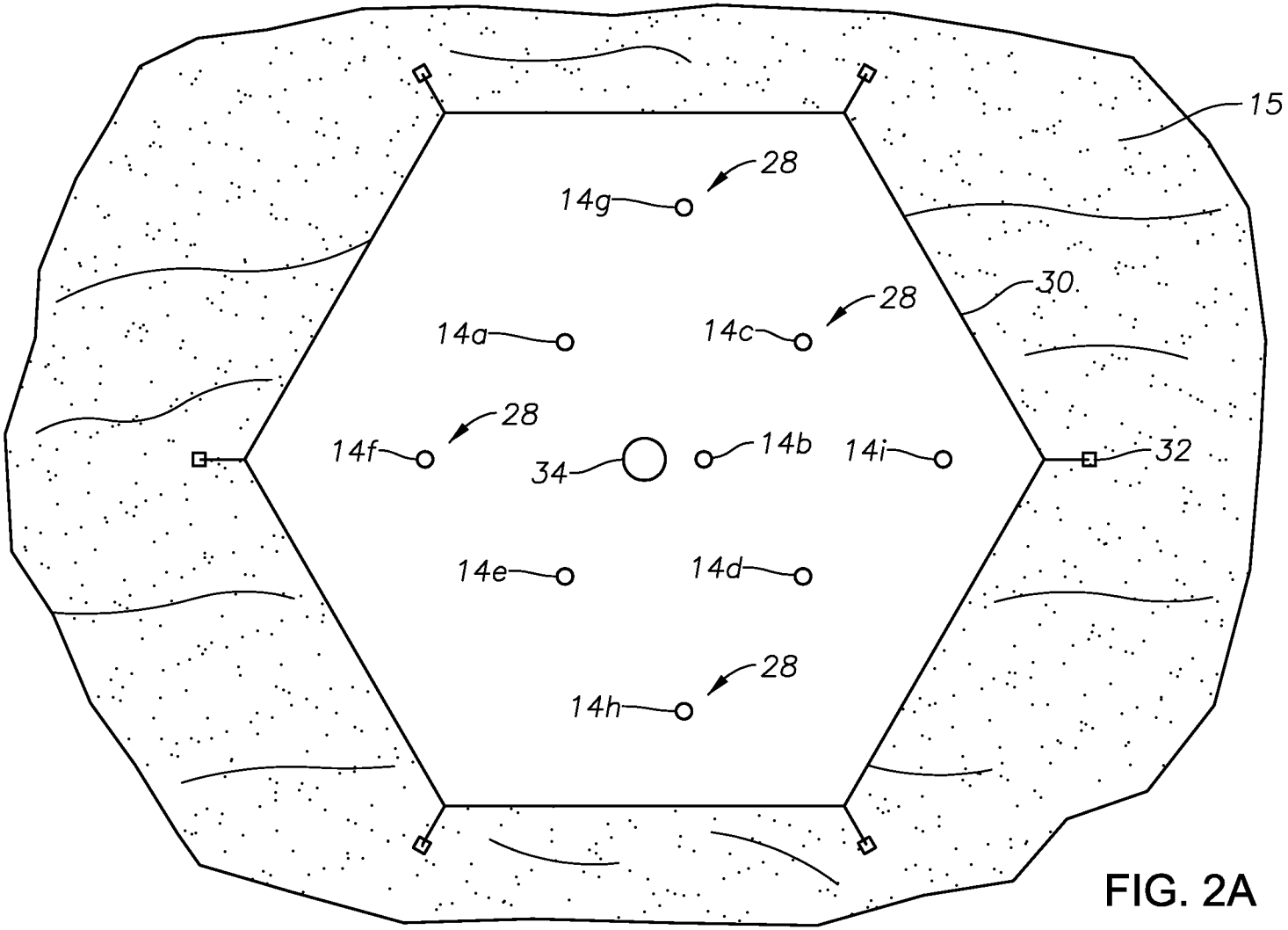
FIG. 2A illustrates an aerial view of a seabed in which an exemplary embodiment of the present invention has been positioned.
Figure 2B:
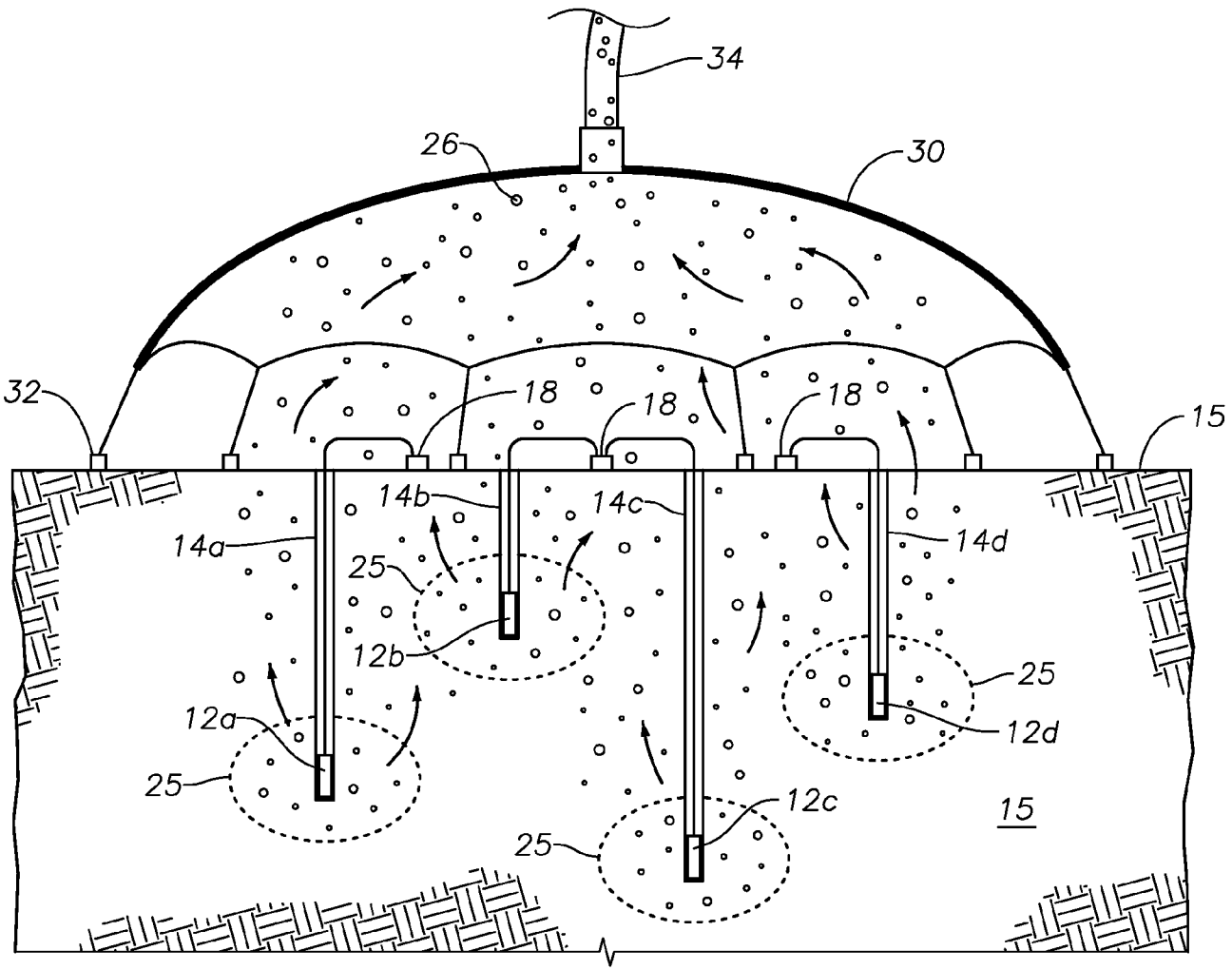
FIG. 2B illustrates a sectional view of an assembly utilizing a plurality of drilling devices according to certain exemplary embodiments of the present invention.

Referring to FIG. 2A, an aerial view of the seabed of hydrocarbon bearing formation 15 is illustrated. In certain exemplary embodiments, a plurality of wellbores 14a-i are drilled simultaneously by a plurality of drilling devices 12. Also shown are the corresponding seabed origination points 28 of each wellbore 14a-i. In other embodiments, however, wellbores 14*a-i* are drilled sequentially by a single drilling device 12. As previously described, bladder 30 extends out beyond the area containing wellbores 14*a*-I, and their associated sublimation ranges 25, a distance sufficient to prevent and/or reduce the possibility of hydrocarbon gas 26 escaping bladder 30 (100 feet or more outside the area, for example). The area containing wellbores 14a-i may take a variety of patterns, including, for example, circular, star, or rectangular shaped patterns. FIG. 2B also illustrates this concept by showing wellbores 14*a-d* being drilled simultaneously by drilling devices 12*a-d*.

Referring back to FIG. 1, a conduit 34 is positioned at the upper end of bladder 30 and extends up to surface vessel 36. In certain embodiments, a pump 38 is coupled to conduit 34 in order to introduce a negative pressure underneath bladder 30, thereby effectively acting to pull hydrocarbon gas 26 up out of hydrocarbon bearing formation 15. In addition, pump 38 may be used to increase or decrease the pressure under balder 30 to otherwise control or assist the sublimation process and the flow of hydrocarbon gas 26. Although not shown, a dehydration mechanism may be positioned on surface vessel 36 in order to remove water vapors from the collected hydrocarbon gas 26. In addition, compression and storage equipment may also be deployed on surface vessel 36, as will be understood by those ordinarily skilled in the art having the benefit of this disclosure.

Referring to FIGS. 1-2B, an exemplary operation utilizing embodiments of the present invention will now be described. Surface vessel 36 is positioned over a seabed of interest and a plurality of drilling devices 12, and associated pods 18, are deployed to the seabed by, for example, lowering the devices from a ship, a barge using cranes, or with the use of remotely operated submarine vehicles (ROV's). Once drilling devices 12 are positioned in place on the seabed, bladder 30 is deployed and secured over the area wherein the plurality of wellbores 14 will be drilled. Thereafter, drilling devices 12 begin to drill a plurality of wellbores 14 from their respective seabed origination points 28.

As drilling devices 12 continue to drill into hydrocarbon bearing formation 15, their respective sensors 22 will detect the presence of hydrocarbon deposits in the vicinity of drilling devices 12. In certain embodiments, drilling devices 12 will continue drilling until they have detected the base of the hydrocarbon deposits. Nevertheless, once detected, processing circuitry on-board drilling devices 12 will initiate operation of sublimation mechanism 24, whereby the desired sublimation operation is conducted. For example, in those embodiments utilizing an acoustic mechanism, one or more shockwaves are injected by sublimation mechanism 24 into the surrounding formation that comprises crystallized hydrates. In those embodiments utilizing temperature inducing mechanisms, sublimation mechanism 24 heats the surrounding formation to a temperature sufficient to sublimate the crystallized hydrates. In those embodiments utilizing a vibration inducing mechanism, sublimation mechanism 24 will produce a vibration sufficient to sublimate the surrounding crystallized hydrates within sublimation range 25. Nevertheless, in response to the agitation introduced by sublimation mechanism 24, the crystallized hydrates then sublimate into hydrocarbon gas 26, which is then released up through hydrocarbon bearing formation 15.

Once captured in bladder 30, the released hydrocarbon gas 26 is transferred through conduit 34 and up to surface vessel 36. The released hydrocarbon gas 26 may then be collected in a suitable collection vessel located on surface vessel 36. As previously described, the released hydrocarbon gas 26 may be methane gas, for example. In certain embodiments, pump 38 may be utilized to alter the pressure beneath bladder 30 in order to assist in or accelerate the release of hydrocarbon gas 26 from wellbores 14.

In addition, certain exemplary embodiments utilize a dehydration mechanism to dehydrate the collected hydrocarbon gas 26. Thereafter, once wellbore 14 is depleted of gas, drilling devices 12 may reverse themselves to drill back out of wellbores 14, as previously described. However, in other embodiments, drilling devices 12 may simply remain buried in their respective wellbores 14. Moreover, in those embodiments which utilize a single drilling device 12 to drill a plurality of wellbores 14, once a first wellbore 14 has been drilled, the drilling device 12 will drill itself out of wellbore 14 and begin drilling a second wellbore 14, where the same process is repeated.

Accordingly, exemplary embodiments of the present invention described herein provide systems and methods for cost-efficient recovery of hydrocarbon hydrates from a seabed. Thus, a number of advantages may be realized. For example, since drilling devices 12 are utilized to both drill wellbore 14 and sublimate the crystallized hydrates, valuable time is saved. In addition, the present invention does not require costly completion of wellbore 14; rather, wellbore 14 only needs to be drilled. Furthermore, drilling devices 12 may be left in wellbore 14, thus saving even more time associated with retrieving the drilling devices. Lastly, the present invention provides an economically viable solution for large scale methane hydrate recovery.

In view of the foregoing, an exemplary methodology of the present invention provides a method to recover hydrocarbon gas from a seabed, the method comprising deploying at least one autonomous, self-propelled drilling devices to the seabed from a surface location; drilling a plurality of wells from the seabed into a hydrocarbon bearing formation using the at least one autonomous, self-propelled drilling device, wherein each of the wells has a respective seabed origination point; positioning a bladder over the seabed origination points of the plurality of wells; sensing a presence of hydrocarbon deposits in a vicinity of the autonomous, self-propelled drilling devices using sensors located on the at least one autonomous, self-propelled drilling device; causing sublimation of the hydrocarbon deposits using a sublimation mechanism located on the at least one autonomous, self-propelled drilling device, thereby causing hydrocarbon gas to be released from the hydrocarbon bearing formation; and capturing the released hydrocarbon gas in the bladder.

In another method, capturing the released hydrocarbon gas further comprises connecting a conduit between the bladder and the surface location; and transferring the released hydrocarbon gas from the bladder to the surface location using the conduit.

Yet another method further comprises collecting the released hydrocarbon gas in a collection vessel at the surface location. In another, capturing the released hydrocarbon gas further comprises capturing released methane gas. In yet another, the seabed origination points form a pattern on the seabed, and wherein positioning the bladder over the seabed origination points further comprises extending the bladder to an area outside the pattern on the seabed. In another method, causing sublimation of the hydrocarbon deposits further comprises at least one of delivering shockwaves through the hydrocarbon bearing formation; causing the hydrocarbon formation to vibrate; or altering a temperature of the hydrocarbon formation. Yet another method further comprises altering a pressure underneath the bladder to assist in releasing the hydrocarbon gas from the hydrocarbon bearing formation. Another method further comprises drilling the at least one autonomous, self-propelled drilling device out of the wells. In yet another, capturing the released hydrocarbon gas in the bladder further comprises dehydrating the released hydrocarbon gas.

An exemplary embodiment of the present invention provides an assembly to recover hydrocarbon gas from a seabed, the assembly comprising an autonomous, self-propelled drilling device adapted to drill a well from a seabed origination point into a hydrocarbon bearing formation; a bladder positioned over the seabed origination point; a sensor located on the autonomous, self-propelled drilling device, the sensor being configured to sense a presence of hydrocarbon deposits in the hydrocarbon bearing formation; and a sublimation mechanism located on the autonomous, self-propelled drilling device, the sublimation mechanism being configured to cause sublimation of the hydrocarbon deposits, thereby releasing hydrocarbon gas from the hydrocarbon bearing formation, wherein the released hydrocarbon gas is captured in the bladder. In another embodiment, the sublimation mechanism is at least one of a vibration inducing mechanism, shockwave inducing mechanism or temperature inducing mechanism. Another embodiment further comprises a conduit connected between the bladder and a surface vessel.

Yet another exemplary embodiment further comprises a pump coupled to the conduit, the pump being configured to alter a pressure underneath the bladder. In another, the autonomous, self-propelled drilling device further comprises a reverse drilling mechanism to drill the autonomous, self-propelled drilling device out of the well. Another embodiment further comprises a mechanism configured to dehydrate the released hydrocarbon gas.

Yet another exemplary methodology of the present invention provides a method to recover hydrocarbon gas from a seabed, the method comprising deploying an autonomous, self-propelled drilling device to the seabed; drilling a well into a hydrocarbon bearing formation using the autonomous, self-propelled drilling devices; positioning a bladder over the well; positioning the self-propelled drilling device in a vicinity of hydrocarbon deposits located in the hydrocarbon bearing formation; causing sublimation of the hydrocarbon deposits, thereby releasing hydrocarbon gas; and capturing the released hydrocarbon gas in the bladder. Another method further comprises connecting a conduit between the bladder and a surface location, and transferring the released hydrocarbon gas from the bladder to the surface location using the conduit.

In yet another method, causing sublimation of the hydrocarbon deposits is performed by causing the autonomous, self-propelled drilling device to perform at least one of: deliver shockwaves through the hydrocarbon bearing formation; cause the hydrocarbon formation to vibrate; or alter a temperature of the hydrocarbon formation. Another method further comprises altering a pressure underneath the bladder to assist in releasing the hydrocarbon gas from the hydrocarbon bearing formation. Yet another further comprises drilling the autonomous, self-propelled drilling devices out of the wells.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although various embodiments and methodologies have been shown and described, the invention is not limited to such embodiments and methodologies and will be understood to include all modifications and variations as would be apparent to one skilled in the art. Therefore, it should be understood that the invention is not intended to be limited to the particular forms disclosed. Rather, the intention is to cover all modifications, equivalents and alternatives falling within the spirit and scope of the invention as defined by the appended claims.

What is claimed is:

1. A method to recover hydrocarbon gas from a seabed, the method comprising:

deploying at least one autonomous, self-propelled drilling device to the seabed from a surface location;

drilling a plurality of wells from the seabed into a hydrocarbon bearing formation using the at least one autonomous, self-propelled drilling device, wherein each of the wells has a respective seabed origination point;

positioning a bladder over the seabed origination points of the plurality of wells;

sensing a presence of hydrocarbon deposits in the hydrocarbon bearing formation using sensors located on the at least one autonomous, self-propelled drilling device;

causing sublimation of the hydrocarbon deposits in the hydrocarbon bearing formation using a sublimation mechanism located on the at least one autonomous, self-propelled drilling device, thereby causing hydrocarbon gas to be released from the hydrocarbon bearing formation; and capturing the released hydrocarbon gas in the bladder.

2. A method as defined in claim 1, wherein capturing the released hydrocarbon gas further comprises:

connecting a conduit between the bladder and the surface location; and transferring the released hydrocarbon gas from the bladder to the surface location using the conduit.

3. A method as defined in claim 2, further comprising collecting the released hydrocarbon gas in a collection vessel at the surface location.

4. A method as defined in claim 1, wherein capturing the released hydrocarbon gas further comprises capturing released methane gas.

5. A method as defined in claim 1, wherein the seabed origination points form a pattern on the seabed, and wherein positioning the bladder over the seabed origination points further comprises extending the bladder to an area outside the pattern on the seabed.

6. A method as defined in claim 1, wherein causing sublimation of the hydrocarbon deposits further comprises at least one of:

delivering shockwaves through the hydrocarbon bearing formation;

causing the hydrocarbon formation to vibrate; or altering a temperature of the hydrocarbon formation.

7. A method as defined in claim 1, further comprising altering a pressure underneath the bladder to assist in releasing the hydrocarbon gas from the hydrocarbon bearing formation.

8. A method as defined in claim 1, further comprising drilling the at least one autonomous, self-propelled drilling device out of the wells.

9. A method as defined in claim 1, wherein capturing the released hydrocarbon gas in the bladder further comprises dehydrating the released hydrocarbon gas.

10. An assembly to recover hydrocarbon gas from a seabed, the assembly comprising:

an autonomous, self-propelled drilling device adapted to drill a well from a seabed origination point into a hydrocarbon bearing formation;

a bladder positioned over the seabed origination point;

a sensor located on the autonomous, self-propelled drilling device, the sensor being configured to sense a presence of hydrocarbon deposits in the hydrocarbon bearing formation; and a sublimation mechanism located on the autonomous, self-propelled drilling device, the sublimation mechanism being configured to cause sublimation of the hydrocarbon deposits in the hydrocarbon bearing formation, thereby releasing hydrocarbon gas from the hydrocarbon bearing formation, wherein the released hydrocarbon gas is captured in the bladder.

11. An assembly as defined in claim 10, wherein the sublimation mechanism is at least one of a vibration inducing mechanism, shockwave inducing mechanism or temperature inducing mechanism.

12. An assembly as defined in claim 10, further comprising a conduit connected between the bladder and a surface vessel.

13. An assembly as defined in claim 12, further comprising a pump coupled to the conduit, the pump being configured to alter a pressure underneath the bladder.

14. An assembly as defined in claim 10, wherein the autonomous, self-propelled drilling device further comprises a reverse drilling mechanism to drill the autonomous, self-propelled drilling device out of the well.

15. An assembly as defined in claim 10, further comprising a mechanism configured to dehydrate the released hydrocarbon gas.

16. A method to recover hydrocarbon gas from a seabed, the method comprising:

deploying an autonomous, self-propelled drilling device to the seabed;

drilling a well into a hydrocarbon bearing formation using the autonomous, self-propelled drilling devices;

positioning a bladder over the well;

positioning the self-propelled drilling device in a vicinity of hydrocarbon deposits located in the hydrocarbon bearing formation;

causing sublimation of the hydrocarbon deposits in the hydrocarbon bearing formation using the autonomous, self-propelled drilling device, thereby releasing hydrocarbon gas; and capturing the released hydrocarbon gas in the bladder.

17. A method as defined in claim 16, further comprising:

connecting a conduit between the bladder and a surface location; and transferring the released hydrocarbon gas from the bladder to the surface location using the conduit.

18. A method as defined in claim 16, wherein causing sublimation of the hydrocarbon deposits is performed by causing the autonomous, self-propelled drilling device to perform at least one of:

deliver shockwaves through the hydrocarbon bearing formation;

cause the hydrocarbon formation to vibrate; or alter a temperature of the hydrocarbon formation.

19. A method as defined in claim 16, further comprising altering a pressure underneath the bladder to assist in releasing the hydrocarbon gas from the hydrocarbon bearing formation.

20. A method as defined in claim 16, further comprising drilling the autonomous, self-propelled drilling device out of the wells.

* * * * *